US007784537B2

(12) United States Patent
Baxter

(10) Patent No.: US 7,784,537 B2
(45) Date of Patent: Aug. 31, 2010

(54) CONTROL LINE PROTECTOR

(75) Inventor: Iain Baxter, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 281 days.

(21) Appl. No.: 11/860,905

(22) Filed: Sep. 25, 2007

(65) Prior Publication Data

US 2009/0078020 A1 Mar. 26, 2009

(51) Int. Cl.
*E21B 17/10* (2006.01)

(52) U.S. Cl. ..... 166/241.6; 166/241.5; 166/241.7

(58) Field of Classification Search ..... 166/241.1, 166/241.4–241.7
See application file for complete search history.

(56) References Cited

U.S. PATENT DOCUMENTS

| | | | | |
|---|---|---|---|---|
| 1,383,777 | A * | 7/1921 | Stephens | 392/301 |
| 3,171,889 | A * | 3/1965 | McCarthy | 174/136 |
| 4,603,737 | A * | 8/1986 | Spikes | 166/241.7 |
| 4,747,454 | A * | 5/1988 | Perryman | 166/380 |
| 5,343,942 | A * | 9/1994 | Del Serra et al. | 166/66.4 |
| 5,379,836 | A * | 1/1995 | Jordan | 166/241.6 |
| 6,412,552 | B1 | 7/2002 | Rooks | |
| 6,588,714 | B2 | 7/2003 | Blane | |
| 6,929,065 | B2 | 8/2005 | Cannon | |
| 7,220,067 | B2 | 5/2007 | Rubinstein | |
| 2005/0045343 | A1 | 3/2005 | Bixenman | |

FOREIGN PATENT DOCUMENTS

| | | |
|---|---|---|
| EP | 930622 | 7/1999 |
| EP | 886032 B1 | 5/2003 |
| GB | 2415932 | 1/2006 |
| WO | 2006005895 A1 | 1/2006 |

* cited by examiner

*Primary Examiner*—Giovanna C Wright
(74) *Attorney, Agent, or Firm*—Kevin B. McGoff; Rodney Warfford

(57) ABSTRACT

An apparatus and method is provided for protecting control lines used with tool strings in a downhole environment. A control line protector assembly comprises a plurality of components formed into a unitary piece which includes a guard section having a first end section and a second end section, a slot on each of the first end section and the second end section, and a securing mechanism for coupling the guard section having the first end section and the second end section to the coupling. A control line protector assembly is formed using a metal stamping process.

9 Claims, 7 Drawing Sheets

CONTROL LINE PROTECTOR

BACKGROUND OF THE INVENTION

1. Field of the Invention

Oil, gas, or water wells commonly employ the use of some form of control lines to communicate with or to provide power to downhole equipment. Examples of control lines used in a downhole environment include electrical lines, hydraulic lines, and fiber optic lines. For example, downhole sensors may communicate measurements to surface equipment over electrical cables or fiber optic lines. Also, hydraulic power can be provided to control downhole components, such as to operate valves or set downhole packers, using hydraulic lines or other lines for communicating fluid pressure. If unprotected, control lines may be easily damaged during deployment of tool strings into the well, or by other movement or operation of downhole components.

Control lines, such as electrical cables, are especially susceptible to damage near the joints between tubing or pipe sections because of the presence of extra components (such as a coupling mechanism) used for attaching the joints. Cable protectors are usually provided at such pipe or tubing couplings to provide protection for electrical cables.

2. Description of Related Art

A cable protector for protecting electrical cables typically includes a body section, in which the electrical cables are accommodated, with the body section coupled to a clamp piece to enable fastening of the cable protector to a tubing or pipe section. However, a specifically manufactured conventional cable protector is rather limited in the types of cable and tubing couplings that it can be used with. As the requirements of a well operation change, tubing or pipe sizes may also need to change. When this occurs, existing cable protectors may not be suitable for use with the different tubings or pipes. As a result, in anticipation of such changes, a well operator may have to keep various different types of cable protectors on hand. This increases the number of components that must be kept by the well operator, which may increase the cost of well operation.

Also, economically efficient manufacturing techniques have generally not been available to form cable protectors and as a result, increased operating costs are experienced by well operators.

BRIEF SUMMARY OF THE INVENTION

According to one embodiment of the invention, an apparatus and method of making a control line protector includes forming a unitary control line protector out of a mild steel using a metal stamping process. The control line protector comprises a guard section having a first end section and a second end section; a slot on each of the first end section and the second end section; and a securing mechanism for coupling the guard section having the first end section and the second end section to the coupling.

Other or alternative features will become apparent from the following description, from the drawings, and from the claims.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments are possible.

Figure 1:
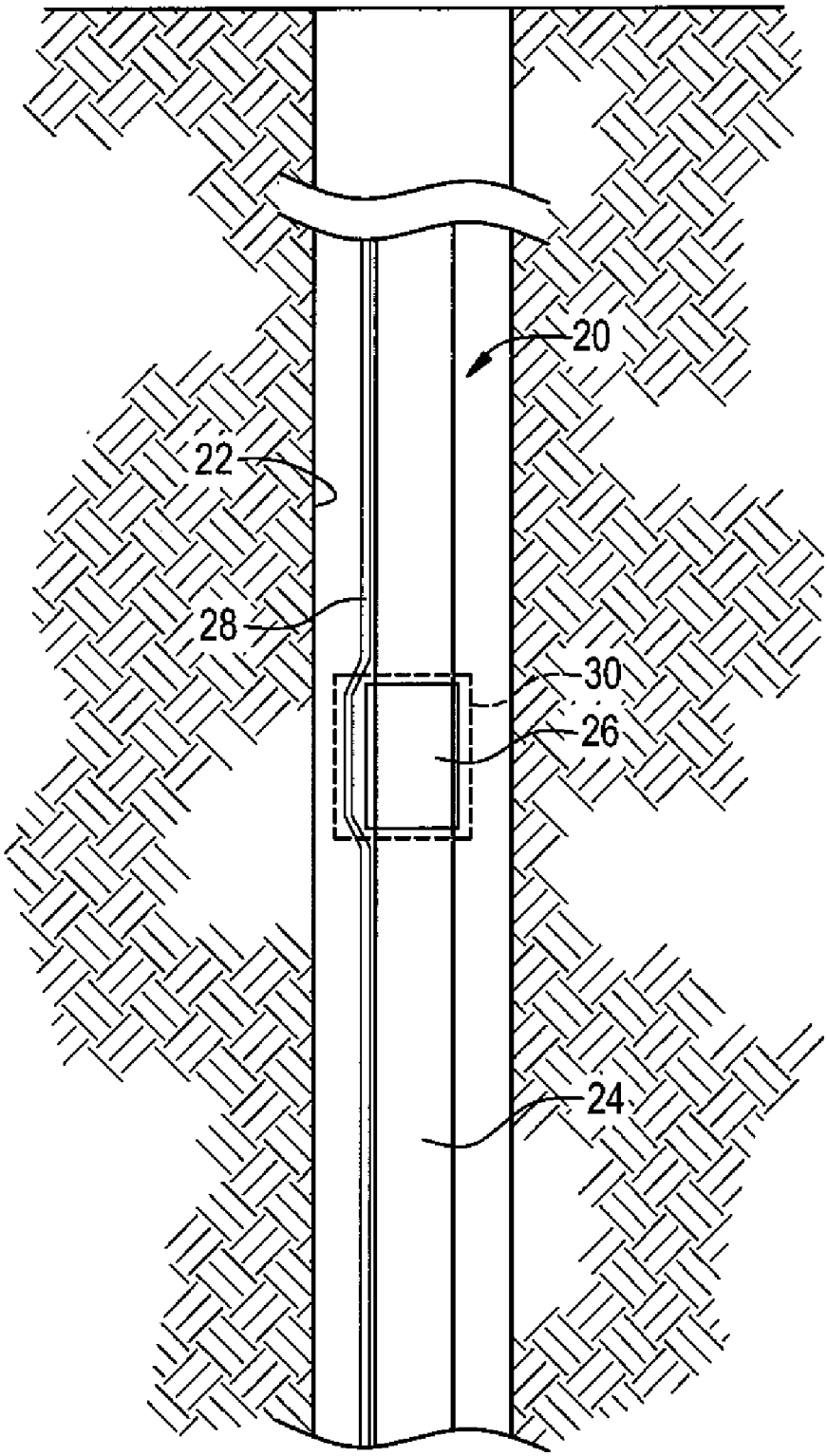
FIG. 1 illustrates a tubing string positioned in a wellbore, according to one example.

FIG. 1 illustrates a tubing string 20, according to one example, positioned in a wellbore 22. The tubing string 20 has multiple tubing sections 24 that are coupled to each other by coupling mechanisms 26. One or more control lines 28 are routed along the outside of the tubing string 20, with the control lines 28 running over the coupling mechanisms 26. Examples of the control lines 28 include hydraulic control lines, electrical cables, fiber optic lines, and the like. Control line protector assemblies 30 according to some embodiments are provided at each of the coupling mechanisms 26 to protect the one or more control lines 28.

Although reference is made to a tubing string 20 in the described embodiments, the control line protector assembly 30 according to some embodiments may be employed with other types of tool strings used in a well. A tubing string may have multiple tubing sections. More generally, a tool string can have multiple string sections.

Figure 2A:
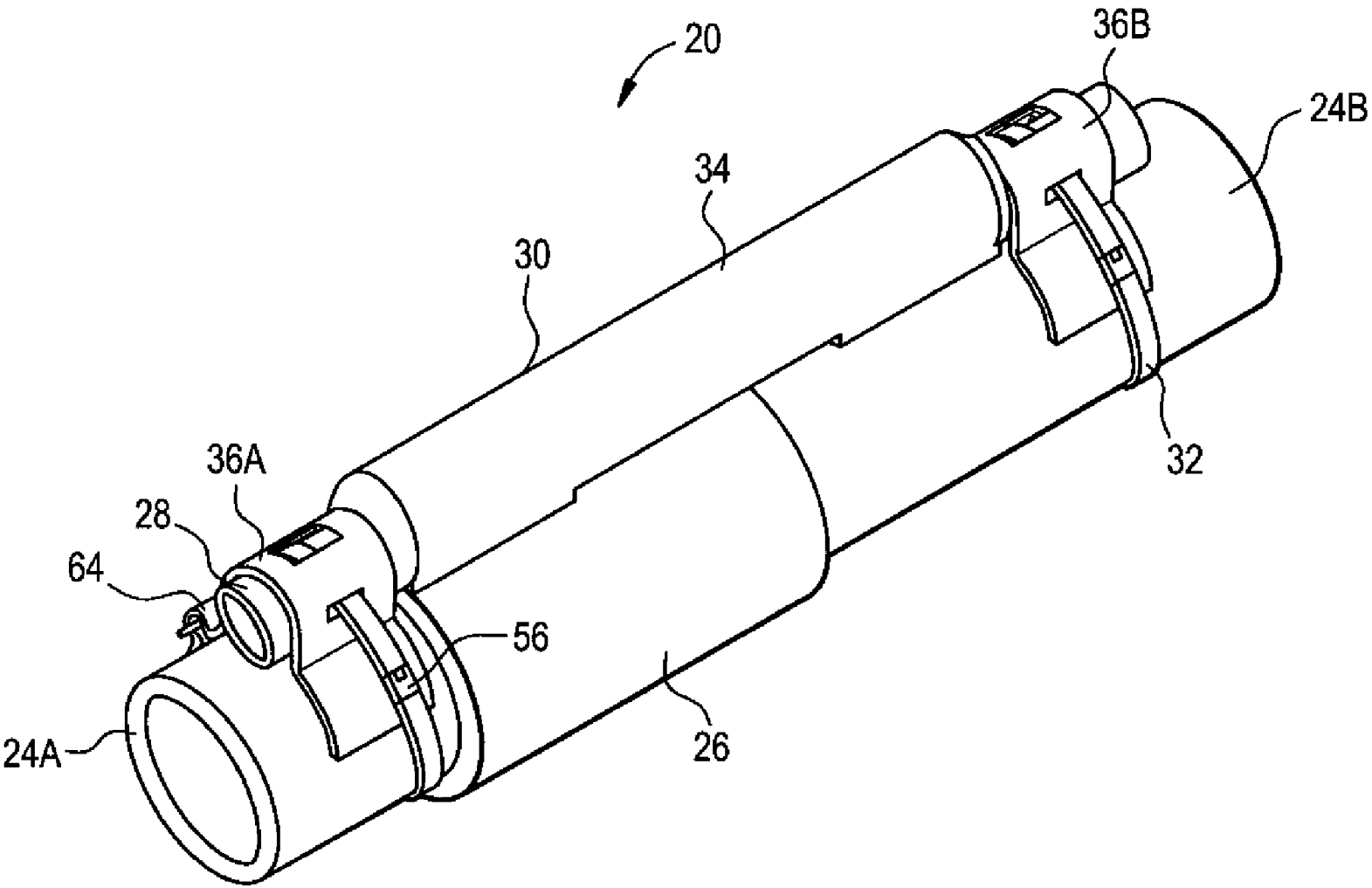
FIGS. 2A, 2B are perspective views of an assembly of tubing sections, a coupling mechanism, electrical control lines, and a cable protector assembly in accordance with an embodiment.
Figure 2B:
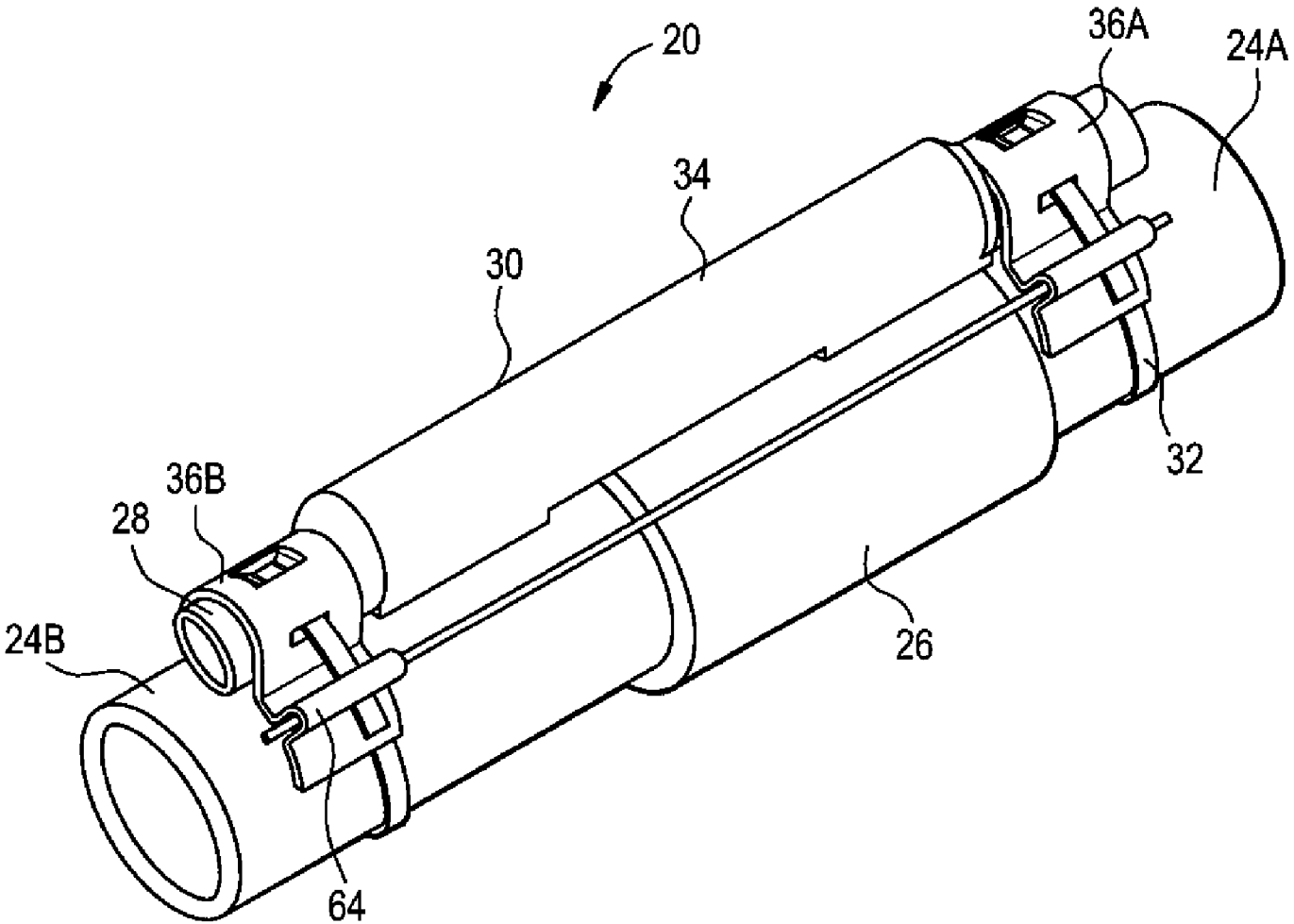

A portion of the tubing string 20 is shown in greater detail in FIGS. 2A, 2B. The portion shown in FIGS. 2A, 2B includes tubing sections 24, a coupling mechanism 26, a control line protector assembly 30, and a securing mechanism 32. In FIGS. 2A, 2B, the tubing sections 24 are shown as tubing section 24A and tubing section 24B, with the two tubing sections 24A and 24B coupled by the coupling mechanism 26. As used herein, a "tubing" refers to any structure, cylindrical or otherwise, that is run into a wellbore in sections that are attached by a coupling mechanism. The "tubing" can be a solid structure, or it can be a hollow structure with a longitudinal bore.

As also shown in FIGS. 2A, 2B, one or more control lines 28 (e.g., an electrical cable) are run along the outer surface of the tubing sections 24A, 24B. The control lines 28 are especially vulnerable at the sections that run over the outer surface of the coupling mechanism 26 because the coupling mechanism 26 is raised above the outer surface of the tubing sections 24A, 24B. To protect the control lines from damage in the region proximate the coupling mechanism 26, the control line protector assembly 30 is mounted over the control lines 28, as shown.

The control line protector assembly 30 includes a guard section 34 that fits over a portion of the housing of the coupling mechanism 26. The guard section 34 is integrally connected with end sections 36 (illustrated as 36A, 36B in FIGS. 1-4) at the two ends of the guard section 34. The end sections 36 are securingly engaged to the tubing sections to enable fastening of the control line protector assembly 30 to the tubing sections. It is understood that profiles in the guard section 34 can be adjusted to modify the dimensions of the guard section 34 so that the control line protector assembly 30 can be fitted with components (e.g., the coupling mechanism 26, the pipe sections 24A, 24B) of varying sizes and configurations. In other embodiments, profiles of the end sections 36 can also be modified.

Figure 3:
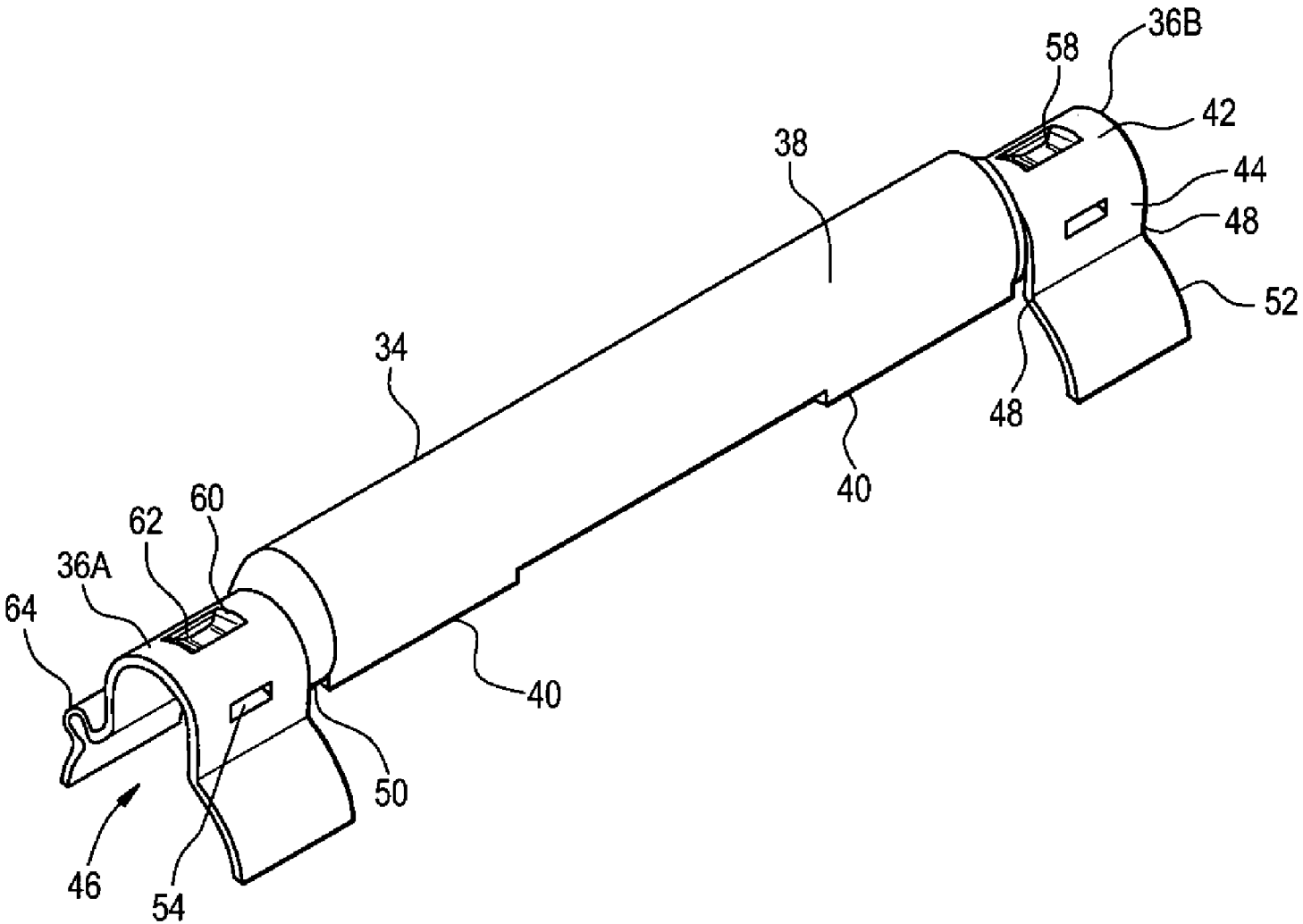
FIG. 3 is a perspective view of a guard section engaged with end sections of the cable protector assembly of FIGS. 2A, 2B.

In the embodiment shown in FIGS. 2A, 2B, the guard section 34 does not extend around the entire circumference of the coupling mechanism 26, but rather it extends less than the entire circumference. This is best seen in FIG. 3, which shows the guard section 34 having a generally arcuate main body 38. Alternatively, the guard section 34 can be generally rectangular in shape in relation to the tubing sections 24A, 24B and the coupling mechanism 26 as described below in FIG. 5.

The guard section 34 may include a plurality of key elements 40 for coupling to the tubing sections and coupling mechanism 26. Preferably, the guard section includes four key elements 40, which are discrete, with one at each corner of the guard section 34. Each key element 40 extends some length L1 along the longitudinal axis of the guard section 34.

Figure 4:
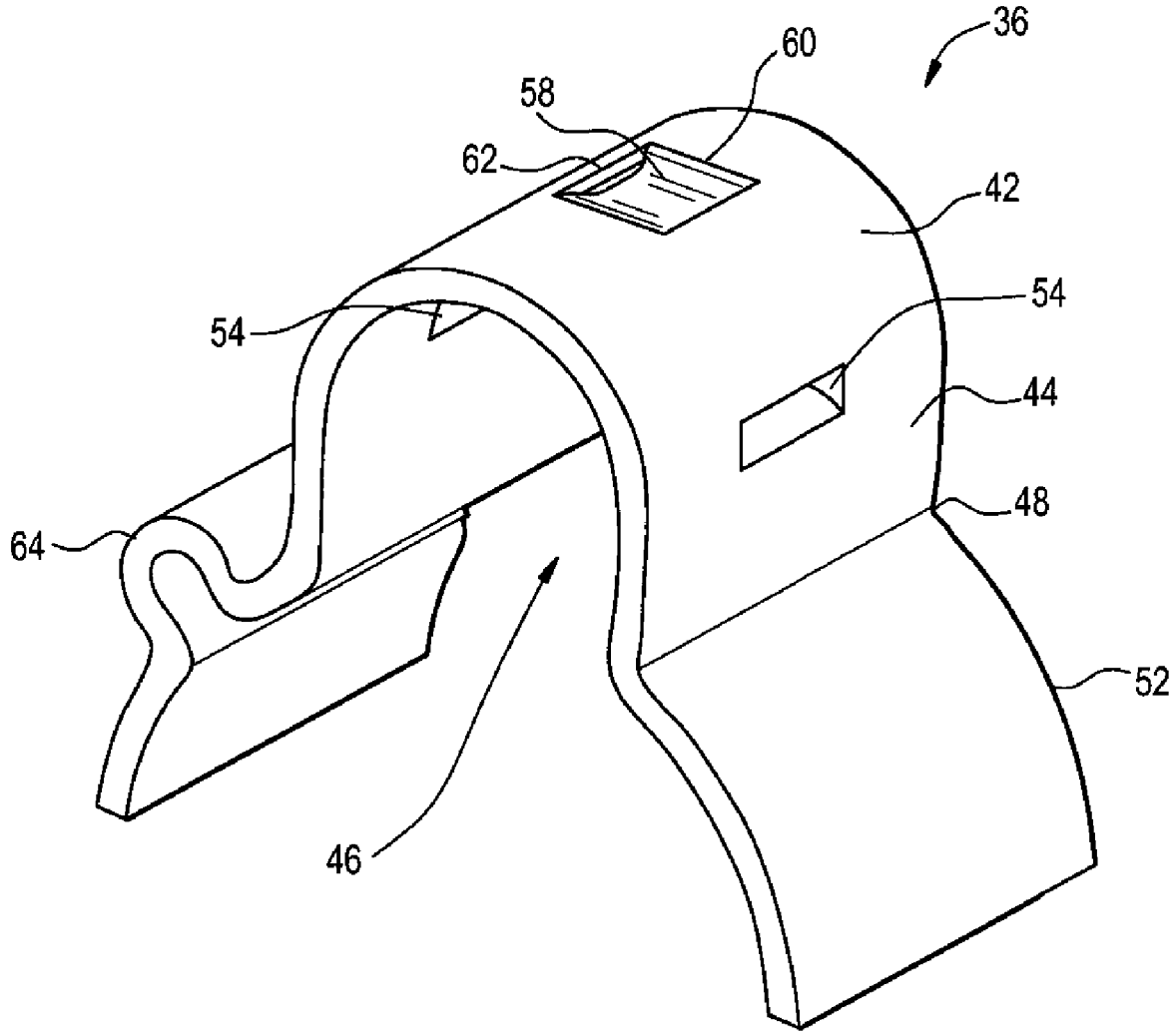
FIG. 4 is a perspective view of the end section of the cable protector assembly of FIGS. 2A, 2B.

The end section 36 also has a generally arcuate main body portion 42 and includes longitudinal side members 44 which extend downwardly from the arcuate main body 42. In the implementation of FIGS. 3 and 4, the arcuate main body 42 and the longitudinal side members 44 are integrally connected. However, in other embodiments, it is understood that the main body 42 and side members 44 may be separate pieces that are connected to each other. The arcuate main body 42 and side members 44 define an inner longitudinal groove 46 for receiving one or more control lines. The longitudinal side members include lower edges 48 which generally extend lower than lower walls of the four discrete key elements. A gap 50 exists between the key element 40 and the outer wall of the side member 44. The gap 50 aids in the pressing process discussed below. However, it is understood that the gap between the key elements and side members 44 is not required in the pressing process.

The side members 44 are connected to outwardly protruding arcuate connector members 52 at the lower edges 48 of the longitudinal side members. The arcuate connector members 52 are for connecting to the outer surfaces of the tubing sections 24A, 24B and/or the outer surface of the coupling mechanism 26. In one embodiment, the side members 44, and the connector members 52 are all integrally connected. In other embodiments, the different pieces can be separate elements that are bonded or attached together.

Each end section 36 is shown in greater detail in FIGS. 3 and 4. As shown in FIGS. 3 and 4, horizontal slots 54 are provided on the side members 44 on the end section 36 for releasably receiving the securing mechanism 32 (FIGS. 2A, 2B). Note that each of the horizontal slots 54 is completely enclosed to provide an enclosed slot or duct. As shown in FIGS. 2A, 2B, the securing mechanism 32 may be pre-cut to a desired length to conform to the distance around the securing mechanism 32 coupled to the tubing sections and/or coupling mechanism 26 which houses the control lines. The securing mechanism 32 may include a securing buckle 56 (FIG. 2A) which secures the securing mechanism 32 which is fed through the slots and pulled to tighten so that the securing mechanism 32 is coupled to the tubing sections. In the alternative, the securing mechanism 32 may include a pre-attached buckle on the securing mechanism 32 which is not free to move (not shown). Effectively, the use of the securing mechanism 32 ties the control line protector assembly 30 to the tubing sections and/or coupling mechanism into an integral assembly.

It is also understood that in another embodiment, each slot 54 may have a snap lock ledge (not shown) within the slot, which is designed to engage the securing mechanism 32. Once the securing mechanism 32 is pushed through the slot 54, and the snap lock ledge engages the securing mechanism 32, the end section 36 and the guard section 34 are engaged and locked with respect to each other to the production tubing 24 and coupling mechanism 26, respectively, in the manner shown in FIGS. 2A, 2B.

The arcuate body portion 38 of the end section 36 also has a securing tab 58 for accommodating and clamping varying types, sizes and dimensions of control lines in the same cable protector assembly and defines a structure through which the control lines 28 can extend. The securing tab 58 is designed to slightly bend down and engage the control line 28 to provide support for the control lines 28. In one embodiment, as best shown in FIG. 4, the securing tab 58 is attached to the arcuate main body portion on one side 60 and free hanging on its three other sides 62. The securing tab may have a sloped inner surface to bend down and secure the portions of the control lines 28 in the groove 46. In other embodiments, other types of securing members may be employed.

The connector member 52 may be further provided with an outer arcuate member 64 for securing controls lines in a separate arrangement from the control lines running along the guard section. In one example implementation, one type of control line (e.g., an electrical cable) runs through the guard section, a second type of control line (e.g., a hydraulic line) runs through an arcuate member on one side of the guard section, and so forth. The outer arcuate members 64 may include securing tabs for clamping varying sizes of control lines. It is understood that the outer arcuate members may be provided on both sides of the guard section.

The control line protector assembly 30 is clamped to the tubing sections 24A, 24B with the securing mechanism 32. The securing mechanism is pre-cut to size depending upon the tubing diameter and control lines that the control line protector assemble is suited for. The length of the guard section 34 (and of the key elements 40) is selected based on the expected size of the tubing sections 24A, 24B and the expected range of length of the coupling mechanism 26.

Figure 5:
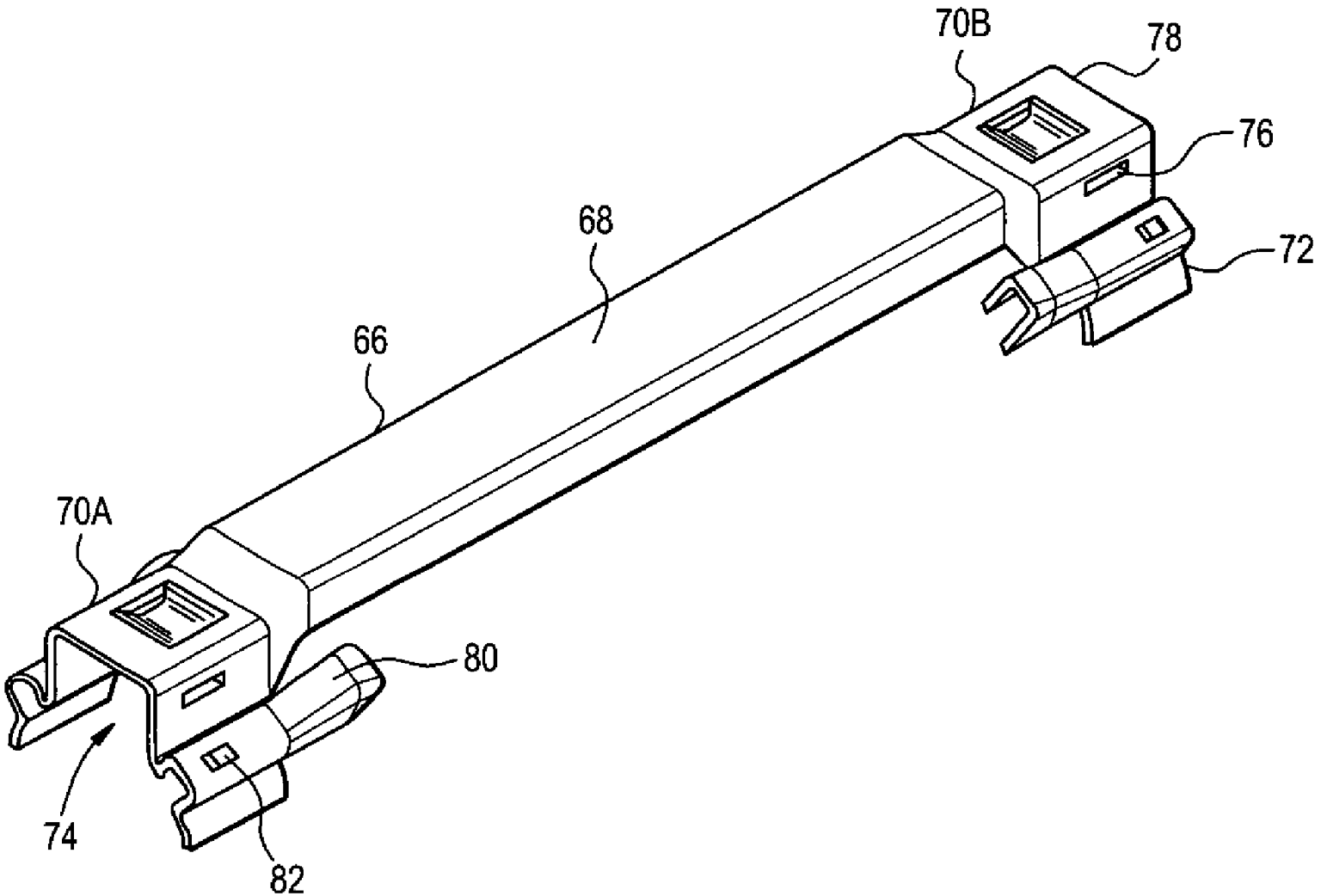
FIG. 5 is a perspective view of another embodiment a guard section engaged with end sections which is rectangular in shape.

In another embodiment, the control line protector assembly 30 may include a guard section 66 having a generally rectangular main body 68 wherein the cross-section of the main body is also generally rectangular, as shown in FIG. 5. For example, a rectangular control line protector assembly may be used with control lines which are flat instead of having a round diameter, or control lines may be encapsulated either singly or in combinations to produce a rectangular flat pack. Similar to the embodiment discussed above, the rectangular guard section 66 is engaged with end sections 70A, 70B which are generally rectangular in shape. Extending from the end sections 70A, 70B are arcuate connector members 72.

The end sections 70A, 70B and the arcuate connector members 72 define an inner longitudinal rectangular groove 74 for receiving one or more control lines 28 (not shown). The arcuate connector members 72 are also for connecting to the outer surfaces of the tubing sections 24A, 24B and/or the outer surface of the coupling mechanism 26.

Each end section 70A, 70B includes horizontal slots 76 for releasably receiving the securing mechanism 32. Note that each of the horizontal slots 76 is completely enclosed to provide an enclosed slot or duct. The rectangular body portion of the end sections 70A, 70B also has a securing tab 78 for accommodating and clamping varying sizes of control lines and defines a structure through which the control lines 28 can extend.

As in the previous embodiment, the arcuate connector members 72 may be further provided with an outer rectangular member 80 for securing controls lines in a separate arrangement from the control lines running along the guard section 66. The outer rectangular members 80 may include securing tabs 82 for clamping varying sizes of control lines. It is understood that the outer rectangular members may be provided on both sides of the guard section.

The control line protector assembly 30 is clamped to the tubing sections 24A, 24B with the securing mechanism 32 as in the previous embodiment. The length of the guard section 66 is selected based on the expected size of the tubing sections 24A, 24B and the expected range of length of the coupling mechanism 26.

Figure 6:
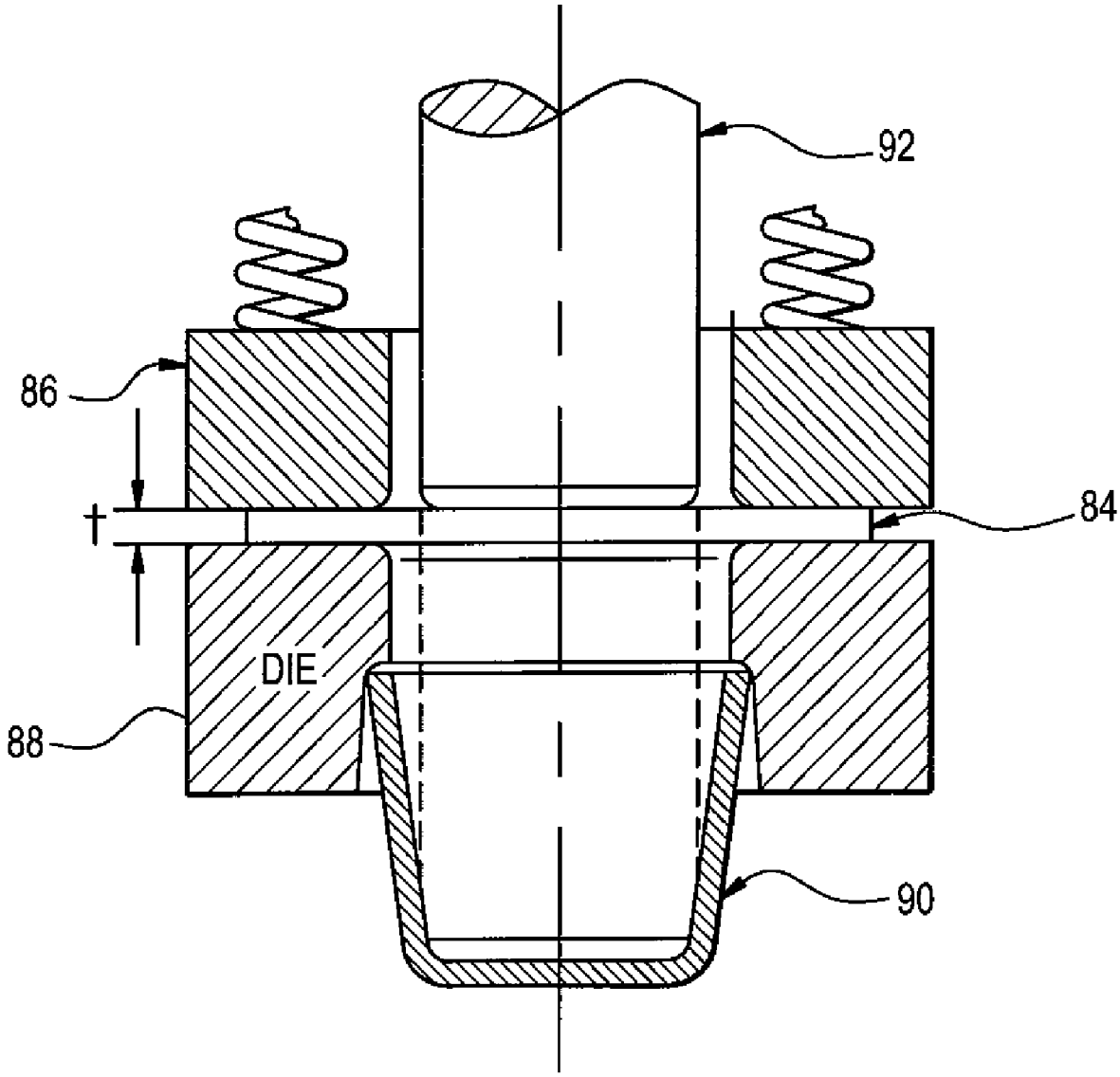
FIG. 6 is a front view of a metal pressing operation using a press die tool.

The embodiments control line protector assembly 30, can be made of various materials, such as any metallic material which is commercially available in a sheet form. Preferably, the control line protector is made of a mild steel using standard metal pressing or stamping operations, as shown in FIG. 6.

The various parts of the control line protector assembly may be formed and integrated into a single-piece unit by using a standard metal pressing or stamping process according to some embodiments of the invention. Metal pressing is the process of forming and cutting a sheet metal into a desired shape and size with the help of a stamping die loaded on a stamping press. As shown in FIG. 6, to form the control line protector assembly which is unitary, a flat metal sheet 84 or blank is placed in a holder 86 and prepared for pressing. The metal sheet may have cut outs or openings where features of the control line protector assembly are located in its final form. The sheet may be loaded into a press die tool 88 having a specific shape 90 and stamped or pressed using a punch 92 such that the finished part takes up the shape of the die. The stamping die may be a single stage tool where the control line protector assembly is completed in every stroke of the stamping die. It is also understood that the process may be a progressive stamping die where a series of various stamping techniques are performed in different stages to produce a more complex metal shaping component.

The press die is configurable to form control line protectors of different configurations. Using the pressing process, a single-piece control line protector can be formed according to specifications of a well operator or other user. The benefit this offers is that a well operator or other user does not need to perform post-molding tailoring to suit a particular tool string. Instead, the control line protector of the desired configuration can be specified in advance, made efficiently and accurately. The control line protector may also be made in large quantities if desired since the stamping die produces high precision metal components which are identical in shape and size.

It is understood that the various components of the control line protector assembly may be metal stamped separately and assembled together to form the control line protector assembly. It is also understood that the control line protector assembly may be manufactured by other means appropriate to the materials of the control line protector assembly including casting, injection molding, extruding. The guard section has a width and height selected to accommodate the expected range of control line sizes, coupling diameters, coupling lengths, and tubing sections.

For improved flexibility in accordance with some embodiments, the control line protector assembly 30 has a number of sections or segments that are attached together. The dimensions of the sections or segments of the control line protector assembly 30 are adjustable by a manufacturer (such as by cropping, cutting, and the like) to adjust the control line protector assembly to fit with tubing sections and coupling mechanisms of various sizes. More generally, the sections or segments of the control line protector assembly 30 can be tailored to suit a given arrangement (e.g., size and length) of at least one of the coupling mechanism 26 and the tubing sections 24A, 24B.

The tailoring of one or more segments of the control line protector assembly 30 can be performed. This enables a manufacturer to keep one type of control line protector assembly 30 for multiple possible arrangements of coupling mechanisms 26 and tubing sections 24A, 24B.

While the invention has been disclosed with respect to a limited number of embodiments, those skilled in the art will appreciate numerous modifications and variations therefrom. It is intended that the appended claims cover such modifications and variations as fall within their scope.

What is claimed is:

1. A control line protector for protecting a control line that is part of a tool string having plural sections and a coupling to attach the tool string sections, the control line protector comprising:

a guard section having a first hingeless end section and a second hingeless end section, the guard section being formed to extend around a control line;

a slot on each of the first end section and the second end section; and a securing mechanism, releasably received through the slot on each of the first and second hingeless end sections, for coupling the guard section having the first end section and the second end section to the coupling, wherein each of the first hingeless end section and the second hingeless end section comprises an arcuate main body portion and arcuate connector members, wherein the arcuate connector members include an outer arcuate member for securing at least one other control line in a separate arrangement from the control line.

2. The control line protector of claim 1, further comprising a securing tab on the first hingeless end section and the second hingeless end section for accommodating and clamping varying sizes of the control line.

3. The control line protector of claim 1, wherein the guard section further includes a plurality of key elements.

4. The control line protector of claim 1, wherein the guard section is generally arcuate in shape.

5. The control line protector of claim 1, wherein the securing mechanism includes a buckle.

6. The control line protector of claim 1, further comprising a sheet of metal which is stamped into a desired shape and size of the control line protector using a press die tool.

7. A control line protector for protecting a control line that is part of a tool string having plural sections and a coupling to attach the tool string sections, the control line protector comprising:

a guard section having a first hingeless end section and a second hingeless end section, the guard section being formed to extend around a control line;

a slot on each of the first end section and the second end section;

a securing mechanism, releasably received through the slot on each of the first and second hingeless end sections, for coupling the guard section having the first end section and the second end section to the coupling; and arcuate connector members attached to the first hingeless end section and the second hingeless end section, the arcuate connector members having outer rectangular members for securing at least one other control line in a separate arrangement from the control line.

8. The control line protector of claim 7, wherein the guard section is generally rectangular in shape.

9. The control line protector of claim 7, wherein the guard section and the first hingeless end section and the second hingeless end section are generally rectangular in shape.

* * * * *